United States Patent [19]

Moskowitz et al.

[11] 3,981,062

[45] Sept. 21, 1976

[54] APEX SEAL COMPOSITION FOR ROTARY ENGINES

[75] Inventors: David Moskowitz, Southfield; James C. Uy, Dearborn Heights, both of Mich.

[73] Assignee: Ford Motor Company, Dearborn, Mich.

[22] Filed: Oct. 1, 1973

[21] Appl. No.: 402,526

[52] U.S. Cl. ..... 29/182.7; 29/182.5; 29/182.8; 75/201; 75/203; 75/204; 418/179

[51] Int. Cl.$^2$ ..... C22C 1/05

[58] Field of Search ..... 29/182.7, 182.8; 75/203, 204, 201; 418/179

[56] References Cited

UNITED STATES PATENTS

| | | | |
|---|---|---|---|
| 3,674,443 | 7/1972 | Daniels | 29/182.8 |
| 3,720,504 | 3/1973 | Frehn | 29/182.8 X |
| 3,752,655 | 8/1973 | Ramquist | 29/182.8 X |
| 3,782,930 | 1/1974 | Shibata | 29/182.8 X |
| R25,815 | 7/1965 | Humenik | 29/182.8 |

*Primary Examiner*—Richard E. Schafer

*Attorney, Agent, or Firm*—Joseph W. Malleck; Keith L. Zerschling

[57] ABSTRACT

An apex seal element for a rotary internal combustion engine is described which is comprised of a cemented carbide having a binder constituted of nickel and molybdenum carbide and a controlled addition of excess free carbon (or equivalent lubricating agent).

13 Claims, 6 Drawing Figures

The grain size of Ferrotic CM is about six times larger than that of 311C at comparable magnifications. The black area in the Ferrotic CM microstructure is typical of the porosity in that material. The dark grey areas in the 311C microstructure are graphite which was added to increase lubricity.

310C+2.5 Carbon 250X

311C+2.5% Graphite 200X

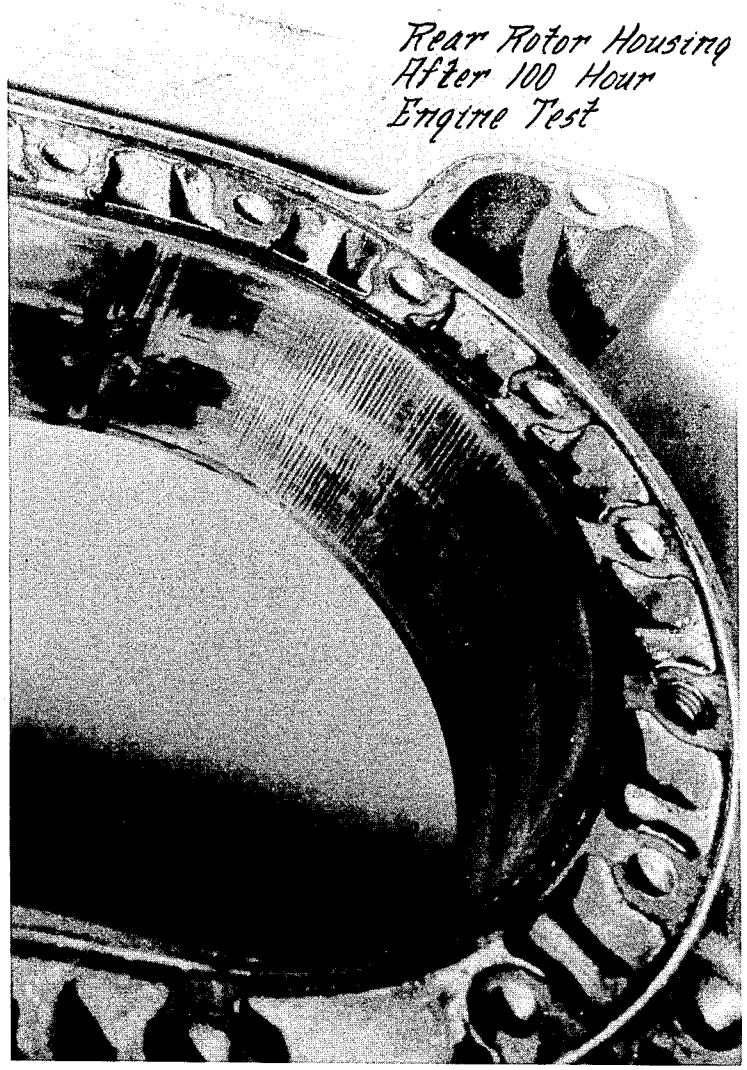
Fig. 5. Rear Rotor Housing After 100 Hour Engine Test
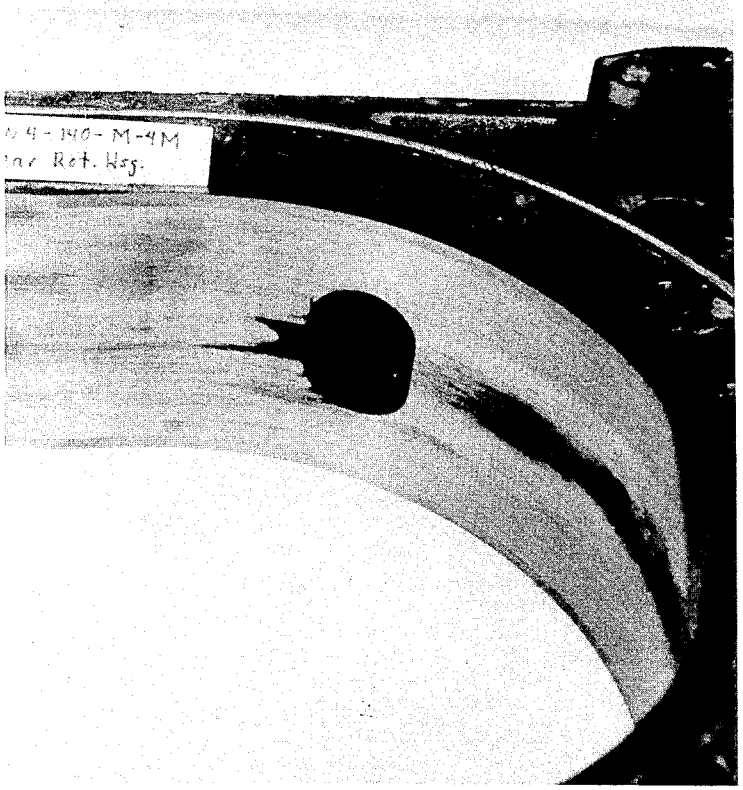
Fig. 6. Rear Rotor Housing After 100 Hour Engine Test 310C+2.5% Graphite

APEX SEAL COMPOSITION FOR ROTARY ENGINES

BACKGROUND OF THE INVENTION

Cemented carbides have proven value for use in cutting tools due to their extremely high wear-resistance, high impact-resistance and generally high strength. It would be most convenient if the technology of cemented carbides could be transferred directly for use as a wear material in the construction of moving parts of a rotary engine. Unfortunately, this has not been possible because certain environmental conditions and design goals of a rotary engine differ radically from the conditions and goals of a cutting tool.

Although the strength and hardness of a cemented carbide is useable, the cermet must no longer function to cut another contacting surface. For example, although a good cemented carbide will have high strength enabling it to be used for a dynamic apex seal of a rotary engine, it is important that the seal element have a compatible frictional wear characteristic with respect to the opposite bearing surface so as to promote a gas-tight seal. Thus, while hardness is important, it is equally important that there be a certain amount of inherent lubricity in the composition of the material to facilitate long life under constant rubbing conditions.

Thermal conditions in a combustion zone of a rotary engine reach severe levels which can cause heat checking in equivalent hard materials. Known cermet materials normally are expected to suffer cracking under such thermal conditions. In addition, the rotor of a rotary internal combustion engine is typically eccentrically mounted so that the apices of the rotor may traverse contours of an epitrochoid formed on the inner wall of the rotor housing. The dynamic forces imposed upon the apex seals, which are adapted to slightly shift within grooves of the rotor, cause the seal element to make unwanted chatter marks on the epitrochid surface of the rotor housing. Eventually, the depth of these chatter marks increase so that sealing effectiveness is dissipated and the engine loses considerable efficiency. It is thought that two aspects play an important role in the problem of chatter, namely inertial or dynamic mass weight of the seal element and the relative freedom from high interengaging friction.

Graphite, including other well ordered crystallites have been known for their lubricating characteristic or freedom from high interengaging friction. The atomic structure is such that slip planes are easily set up parallel to the rubbed surface. Consideration as to the presence and effect of excess carbon (graphite) on the properties of cemented carbides, particularly sintered tungsten carbide, has been well documented to reveal the state of the art. In all cases, the art holds the view that free carbon in cemented carbides is generally detrimental causing a drop in strength, hardness, and impact resistance. For example, the mechanical properties of sintered tungsten carbide-cobalt alloys have been analyzed in an article by Al D. Brownlee, R. Edwards and T. Raine, *Symposium on Powder Metallurgy*, page 302–304, 1954. It is stated, starting on page 303, that "the presence of free carbon tends to encourage the grain growth of tungsten carbide. This leads to a fall in hardness but the carbon itself, if present only in small amounts, does not noticeably affect the hardness. However, if the excess is so great that it causes the formation of 'rosettes' the hardness will be very greatly reduced. The presence of excess carbon has two conflicting effects on the transverse rupture strength of these alloys. The increase in grain size of the tungsten carbide tends to increase the transverse rupture strength, but at the same time the precipitation of graphite in the form of clusters and rosettes forms weak points in the material, which leads to a lowering of the transverse rupture strength. The net effect is that, as the carbon content increases, the transverse rupture strength first increases very slightly and then falls off rapidly."

Again in an article by D. N. French and D. A. Thomas, *International Journal of Powder Metallurgy* (III), 1967, it is concluded on page 14 that "Excess carbon-type defects reduce the transverse rupture strength and impact strength of tungsten carbide — 10 wt. % cobalt alloys". Lastly in an article in the *Journal of Metals*, 1954, by J. Gurland, Transactions of AIME, page 200, and particularly on page 287, it is stated "graphite moderately decreases strength and hardness". This also is in reference to a tungsten carbide — cobalt alloy. Thus, the prior art has not appreciated the virtue of excess free carbon for rotary engine applications.

A typical commerical seal of cemented carbide comprises 35% titanium carbide, 5.75% chromium, 2% molybdenum, 0.56% carbon and the balance iron; this cermet is commonly referred to as Ferrotic CM.

SUMMARY OF THE INVENTION

A primary object of this invention is to provide a rubbing apex seal element for a rotary internal combustion engine which is effective to substantially reduce seal chatter, rotor housing wear, and seal heat checking.

Another object of this invention is to provide an apex seal element comprised of a cemented carbide having a controlled and homogeneously distributed lubricating agent without sacrificing required strength and hardness qualities required by said seal.

A still further object is to provide a new and unique cemented carbide containing 1–15% graphite and yet is capable of functioning efficiently as a load bearing engine component.

A particular feature pursuant to the above objects is the preparation of a seal element having a cemented carbide composition containing by weight 5–60% nickel, 0–15% $Mo_2C$, 1–15% of a lubricating agent (graphite, $MoS_2$, BN) and the remainder a carbide of tungsten, titanium, zirconium, vanadium, tantalum, niobium, or chromium.

SUMMARY OF THE DRAWINGS

FIGS. 5 and 6 represent comparison photographs of rear rotor housings for a rotary engine after 100 hours of engine testing, one representing a typical prior art construction and the other representing the inventive structure.

DETAILED DESCRIPTION

Figure 1:
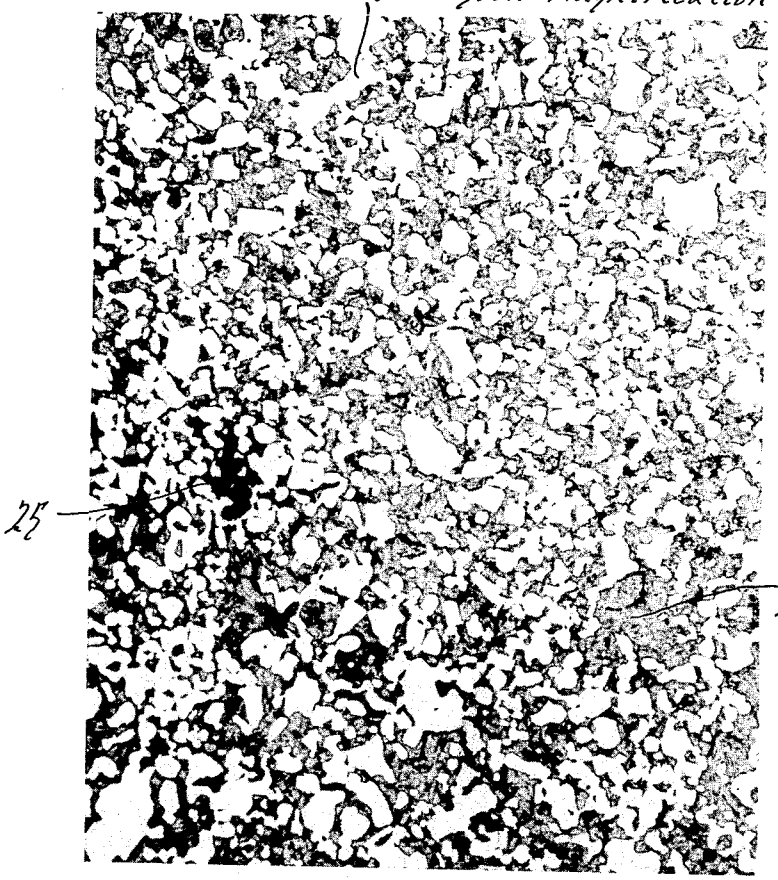
FIG. 1 is a 500X magnification photomicrograph of a prior art cemented carbide material used for an apex seal element.

As indicated earlier, the view that the presence of free carbon in cemented carbides is detrimental is broadly held by persons skilled in that field, and is considered common knowledge. Therefore, the acknowledged advantages of cemented carbides, such as their high wear resistance and high transverse rupture strength, have been lost and obscured by this viewpoint for use as a material in the sealing of rotary internal combustion engines. It was surprising indeed, when the discovery of this invention was made, that an improvement in engine properties resulted from a controlled excess of carbon in a cemented carbide. This has been particularly observed with respect to the application of titanium carbide having a nickel-molybdenum carbide binder.

Several apex seal constructions were fabricated from a composite of titanium carbide particles dispersed in a nickel-molybdenum based metal matrix. Each of these composites also contained a lubricating agent, preferably in the form of excess carbon. It was observed after engine tests of more than 100 hours using these apex seals, that the traditional problems of "chattering" and "heat checking" were substantially reduced. It is believed that the presence of a solid lubricant in the titanium carbide-metal matrix helps to reduce chatter and heat checking without considerable sacrifice of conventional physical properties.

Each of the seal elements of this invention can be typically of a strip configuration which are adapted to fit loosely within a groove at the apex of a triangulated rotor. The crown of the strip is designed to rub against the mating internal wall of a typical trochoid rotor housing and the ends of the strip bear against a portion of the side housing. A gas-tight seal is provided when gas pressure from the combustion zone of the housing interior urges the seal strip tightly against one side of the groove on the rotor and an inertial force urges the crown against the opposite rubbing surface (rotor housing). The trochoid shape of the opposite rubbing surface, necessitated by the eccentric mounting of the rotor, produces a variation in inertial forces during a single revolution acting on a seal. Surface asperities and inertia variation combine to produce an unwanted chatter marking on the rotor housing after a predetermined amount of use. The disclosure in co-pending application Ser. No. 391,409, filed on Aug. 24, 1973, entitled "Apex Seal Design" by J. Uy and Y. Telang is incorporated herein by reference for purposes of further apex seal construction features.

As a preferred compositional mode (designated 311C) for the seal strip, a base material for the composite was prepared from titanium carbide powder having a particle size less than 325 mesh, and having the following analysis:

| | Actual | | |
|---|---|---|---|
| Combined carbon | 19.54% | 19.2% | typical min. |
| Free carbon | 0.18% | .2-.3% | typical |
| Titanium | 79.3% | 79.0% | typical min |
| $O_2$ | .17% | .03% | (max.) |
| Sulphur | .028% | .03% | (max.) |

-continued

| | Actual | | |
|---|---|---|---|
| Iron | .049% | .05% | typical |

The binding alloy was prepared from approximately a 3 micron nickel powder and a 3 micron molybdenum carbide powder. In addition, carbon was added as pure graphite powder having a particle size less than 200 mesh. It should be understood, that the carbon can be added in a graphitic, amorphous, or vitreous form and the percentage of carbon addition can be as high as permissible without excessive loss of strength (as long as the apex seals do not fracture under severe engine running conditions).

The binding alloy, graphite and base material powder were admixed together and subjected to a grinding operation in a Hastelloy B mill to which acetone was added to prevent oxidation of the powders during milling. Approximately four percent by weight of "Carbowax 600" polyethylene glycol was added to the mill charge as a pressing lubricant. The milling was carried on for 4 days, after which the slurry was separated from the milling media and the acetone evaporated away. The dried powder was screened through a size 20 mesh sieve, and then pressed into compacts at approximately 10 tons per square inch. The travel of the punch used to press the compacts was that commonly used in a slow pressing action. Dewaxing of the polyethylene glycol lubricant was carried out by heating the compacts for one hour at 1200°F. under a dry hydrogen atmosphere. Final sintering of the compacts was accomplished by holding them for one hour at 2500°F, under a vacuum of less than one micron absolute pressure while the compacts were supported on a graphite substrate.

An analysis of the resulting composition as prepared according to the above processing steps, was: 42.5% titanium carbide, 49% nickel, 6% $Mo_2C$, and 2.5% graphite.

The following table lists results of measurements which show the improvement in "chatter" when comparing a composition prepared by the preferred mode (311C) and a commercial cemented carbide having no excess carbon. The commercial cemented carbide is known under the tradename "Ferrotic" and contains the following analysis by weight: 35% TiC, 5.75% chromium, 2% Mo, 0.56% C, and the balance iron. The measurements in Table I give the peak-to-valley heights for chatter marks at three different locations within the engine rotor housing after one hundred hours of testing each material.

TABLE I

| Apex Seal Material | Location No. 1 Microinches | Location No. 2 Microinches | Location No. 3 Microinches |
|---|---|---|---|
| Preferred mode | 20-50 | 100-200 | 40-60 |
| Ferrotic CM | 40-120 | 150-290 | 80-140 |

It can be seen from the above table that the preferred mode composition produced one-half to two-thirds of the chatter mark heights of the Ferrotic seals. This is also clear from the photographs of the rotor housing interiors compared after one hundred hours of engine testing (see FIGS. 4 and 5). The seals for these engine tests were run against a rotor housing having a trochoid wall coated with electrolytically deposited nickel with a uniform suspension of silicon carbide, the coating having a hardness of at least 32 $R_c$.

Another composite example for the seal element (designated 310C) was prepared similar to the preferred mode, where graphite was milled along with the carbide and binder mixture. This example consisted of 39% nickel, 7.3% $Mo_2C$, 2.4 graphite, and 51.3% titanium carbide. This example exhibited the following physical properties: TRS of 134,000 psi; impact strength of about 5 inch-pounds; hardness of 67 $R_c$, lubricating quality as determined by a peak-to-valley heights of chatter grooves between 35–150 microinches.

The same general improvement in physical properties has been noticed and can be obtained with some variation in the chemistry from that of the preferred mode. For example, other lubricating agents such as molybdenum disulfide ($MoS_2$) or boron nitride can be utilized in place of the graphite. It is important, however, that the lubricating agent be present in the range of 1–15% of the cemented carbide so that the properties of hardness and transverse rupture strength will not be below requirements. It is also important that the alloy binder for the cemented carbide be comprised of 5–60% nickel and 0–15% $Mo_2C$ with the remainder, of course, being a cemented carbide such as tantalum, vanadium, tungsten, titanium, niobium, chromium, zirconium or hafnium carbide. In those cases where the carbide particles are of a very fine size, the nickel content can be as low as 5–10%; but in most instances the carbide particles are under 5 microns which demands that the nickel content be in the range of 39–60% for optimizing the physical properties of the seal structure. Some of the nickel can be replaced by iron or cobalt preferably in no greater amounts than 70%, but feasible up to 100%.

The molybdenum carbide determines the wetting characteristic of the carbide particles and is absorbed in the outer region of the carbide grains, but not the core. Therefore $Mo_2C$ is essential to the composite unless some other mechanism, such as very fine particles size and controlled increase used of compacting forces, is to obviate the requirement for wetting. The molybdenum carbide content can not, of course, be too high in the composite because strength begins to drop off resulting from the formation of a $Ni_3Mo$ compound which is rather brittle. To this end, the required range for $Mo_2C$ is 0–15%.

Figure 2:
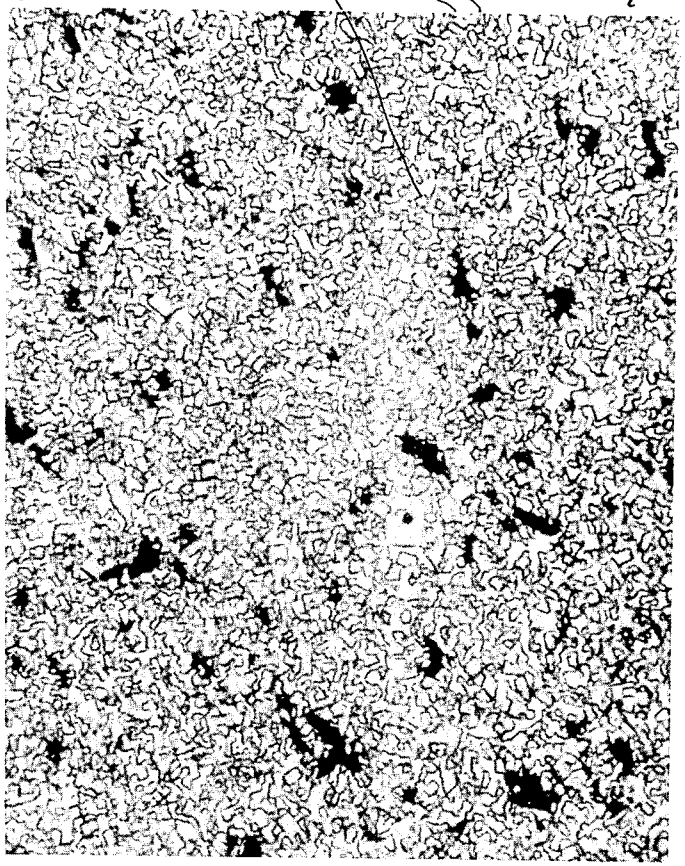
FIG. 2 is a 1500X magnification photomicrograph of a portion of a seal element having a composition according to the teachings of this invention.
Figure 3:
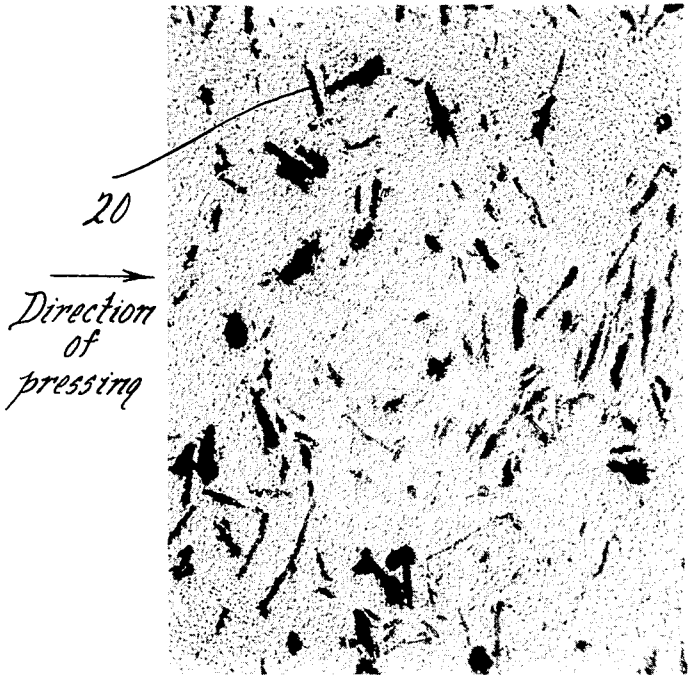
FIG. 3 is a 250X magnification photomicrograph of a portion of the seal element of this invention, the composition having excess carbon admixed and not milled in during grinding of the carbide powder.
Figure 4:
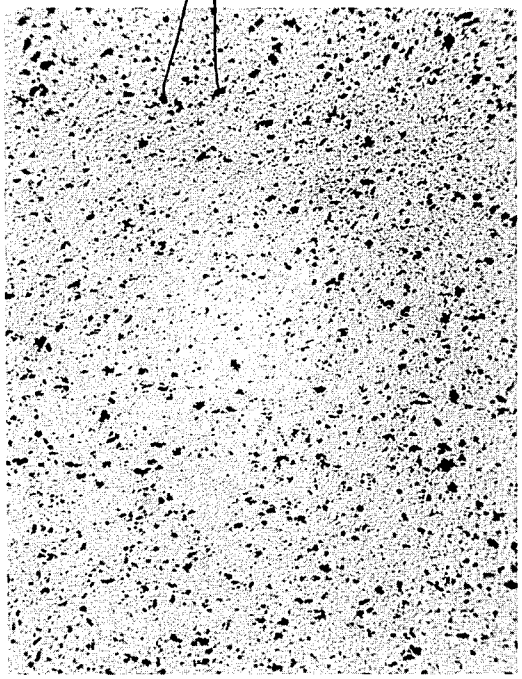
FIG. 4 is a 200X magnification of a portion of seal element comprised of a material embodying the teaching of this invention.

It is important that during preparation of the admixture (to be pressed and liquid phase sintered), that the addition of graphite be thoroughly mixed to promote a uniform distribution of the graphite particles. In FIG. 3, the graphite was tumbled into the base binder powder mixture, rather than milled into such mixture. The result produced flake type graphite particles 20 which tended to lay substantially transverse to direction 21 of pressing. This may be considered a style of orientation that may be advantageously employed in certain applications. Preferably, the graphite addition should be milled into the mixture as in the preferred mode rendering an excellent distribution as shown in FIG. 4. A highly homogeneous uniform distribution of graphite particles or rosettes 20 will be produced as shown in FIGS. 2 and 4. Equally distributed on a uniform basis is the titanium carbide impregnated with $Mo_2C$, plus binder composed of nickel, as shown in FIG. 2. This contrasts sharply with the microstructure of a popular cemented carbide now used commercially for apex seals and constituted of "Ferrotic cm". This latter material is comprised of relatively coarse titanium carbide held in a binder of chromium-molybdenum tool steel and has no excess carbon. As shown in FIG. 1, the Ferrotic material has some areas 23 of tool steel binder which are devoid of titanium carbide. Similarly there are areas 24 of titanium carbide which are devoid of tool steel binder. Porosity 25 is exhibited which does not exist in the examples of this invention; such as illustrated in FIG. 2 at much higher magnification. All large dark areas shown in FIG. 2 are graphite; titanium carbide (TiC) and nickel (Ni) are uniformly distributed throughout.

The physical properties required for use of the described material as a body for an apex seal are met by observing the admixture content ranges set forth. TRS (Transverse Rupture Strength) and hardness are extremely sensitive to the graphite content. However, 50,000 psi for TRS is minimum required for apex seal applications and can be obtained by the invention with a maximum of 15% graphite coupled with some variation in the process. At this latter graphite content, hardness will be in the range of 20–32 $R_c$. Hardness matched to or equivalent to the hardness of the rotor housing coating can be obtained by varying the process technique for each material. For example the electrolytic Ni-SiC material can be softened somewhat to about 32–35 $R_c$ by controlling deposition. The material of this invention can obtain about 15% provided carbon is added in the vitreous form and other precautions are observed to prevent hardness from dropping below 30 $R_c$. Lubricating qualities will be extremely good at the maximum graphite content, leaving little trace of chatter, and impact resistance will be about 1.3 inch-pounds. When graphite is reduced to 1%, TRS will be about 270,000 psi, hardness about 66 $R_c$, lubricating qualities advanced over no graphite, and impact resistance of about 8.5 inch-pounds.

Density variation due to graphite variation is an important feature of this invention which facilitates a reduction in chatter. At 7.5% graphite, the seal will have a density of about 4.8 grams/c.c. and, at 15% graphite, the seal will have a density of about 3.1 grams/c.c.

The many advantages which flow from a practice of this invention are: increase in lubricating qualities with attendant decrease of chatter, less tendency, has a finer grain size whereby metal matrix does not wear away leaving protruding carbides, surface preparation by machining is not as critical, and does not need heat treatment to obtain good properties.

We claim as our invention:

1. A seal element providing a dynamic seal between an eccentrically rotated rotor and a surrounding rotor housing for a rotary internal combustion engine, said element comprising a body of cemented carbide characterized by a weight analysis having 5–60% unalloyed nickel, 0–15% molybdenum carbide, 1–15% of an unprecipitated lubricating agent selected from the group consisting of graphite, $MoS_2$, and boron nitride, and the remainder being substantially a carbide of titanium, the composition being substantially free of iron or cementite.

2. An apex seal element for rotary internal combustion engine, said element constituted of a cemented carbide having additional and sufficient free carbon to form precipitated carbon rosettes uniformly distributed throughout said carbide.

3. The seal element as in claim 1, in which up to one-half of said nickel is replaced by one or both of iron and cobalt.

4. A seal element as in claim 1 in which said nickel content is in the range of 39–60% by weight.

5. A seal element as in claim 1, in which said titanium carbide is comprised of fine particles having a size no greater than 5 microns. and said nickel being lower in content in the range of 5–10%, said carbide admixture being compacted under pressures greater than 20,000 psi.

6. A seal element as in claim 1, in which the resultant mass of said element is no greater than 6.0 grams/c.c., and the impact resistance of said element is at least 8 inch-pounds.

7. A seal element as in claim 1, in which the cemented carbide is preferably comprised of about 40% nickel, about 7.5% $Mo_2C$, about 2.5% graphite and the remainder titanium carbide.

8. A seal element as in claim 1, in which the cemented carbide is preferably comprised of about 39% nickel, about 7.3% $Mo_2C$, about 2.4% graphite, and about 51.3% titanium carbide.

9. The seal element of claim 1 for use in a dynamic rubbing seal assembly wherein the interengaging wall for said seal has a hardness value of about 32 $R_c$ and the hardness value of said element being about 32 $R_c$.

10. The seal element of claim 1 for use in an assembly wherein said element is adapted to engage a wall constituted of electrolytically deposited nickel having a uniform suspension of silicon carbide particles.

11. A seal element as in claim 1 characterized by a transverse rupture strength of at least 50,000 psi, a hardness value of at least 32 $R_c$, an impact resistance of at least 1 inch-pound, and a lubricating quality which is effective to control chatter grooves on an interengaging surface after 100 hours of engine use, said grooves having a peak valley height which varies between 35–100 microinches.

12. A method of making an improved apex seal shape for use in a rotary internal combustion engine, comprising:

a. preparing an admixture of titanium carbide powder particles with a mesh size of −300, nickel and molybdenum carbide powder having a mesh size of −180, graphite powder with a mesh size of −200, regulating said admixture to have an analysis of 10–60% nickel, 0–15% $Mo_2C$, 1–15% graphite, and the remainder TiC, b. milling said admixture for at least one and half hours, c. pressing said admixture into an apex seal shape having a green strength density of at least 90% of fully dense, d. subjecting said shape to a temperature to form a liquid phase of said nickel and molybdenum carbide powders while permitting less than 1% of said graphite powder to be dissolved in said admixture and to provide sufficient liquid phase sintering to form a strong cemented carbide having an intimate and uniform distribution of graphite rosettes, carbide particles, and nickel binder, and being substantially free of porosity.

13. A seal element providing a dynamic seal between an eccentrically rotated rotor and a surrounding rotor housing for a rotary internal combustion engine, said element comprising a body of cemented carbide characterized by weight analysis having 5–60% unalloyed nickel, 0–15% molybdenum carbide, 1–15% of an unprecipitated lubricating agent selected from the group consisting of graphite, $MoS_2$, and boron nitride, and the remainder being substantially a carbide selected from the group consisting of titanium carbide, tungsten carbide, zirconium carbide, hafnium carbide, niobium carbide, tantalum, and $Cr_3C_2$.

* * * * *